United States Patent [19]

Vachon

[11] Patent Number: 4,717,166

[45] Date of Patent: Jan. 5, 1988

[54] HOOK TYPE QUICK COUPLING FOR TRACTOR IMPLEMENT

[76] Inventor: Bertrand Vachon, 2815, chemin de l'aéroport, Thetford Mines, Canada, G6G 5R7

[21] Appl. No.: 20,385

[22] Filed: Mar. 2, 1987

[51] Int. Cl.[4] ..... B60D 3/00

[52] U.S. Cl. ..... 280/481; 280/495

[58] Field of Search ..... 280/481, 495, 497, 499, 280/504; 37/231; 172/274, 817

[56] References Cited

U.S. PATENT DOCUMENTS

| | | | |
|---|---|---|---|
| 2,699,615 | 1/1955 | Malvese | 280/481 |
| 3,512,804 | 5/1970 | Siegert | 280/481 |
| 3,746,368 | 7/1973 | Glenhill et al. | 280/481 |
| 4,342,163 | 8/1982 | Hoekstra | 28/495 |

*Primary Examiner*—John J. Love
*Assistant Examiner*—Donn McGiehan

[57] ABSTRACT

There is disclosed a quick coupling assembly for coupling a working implement to the front of the tractor. A front push-frame is adapted to be attached to the tractor chassis, with the front portion of the push-frame projecting forwardly of the tractor. Said front portion includes two upright legs, each provided with a horizontal stud and with a retractable locking pin below the stud. The assembly further includes a hook frame adapted to be attached to the back of a working implement, such as a plow or snowblower. The hook frame includes a pair of transversely-spaced hook plates, each having an upper downwardly-turned hook member and a hole below the hook member. To couple the hook frame, to the front push-frame, it is only necessary to drop the hook members on the studs and to allow the spring-biased locking pin to enter the holes of the hook plates. Hydraulic cylinders are provided to raise and lower the working implement through action on the push-frame. A system is also provided to adjust the vertical inclinations of the legs of the push-frame.

9 Claims, 11 Drawing Figures

FIG. 10
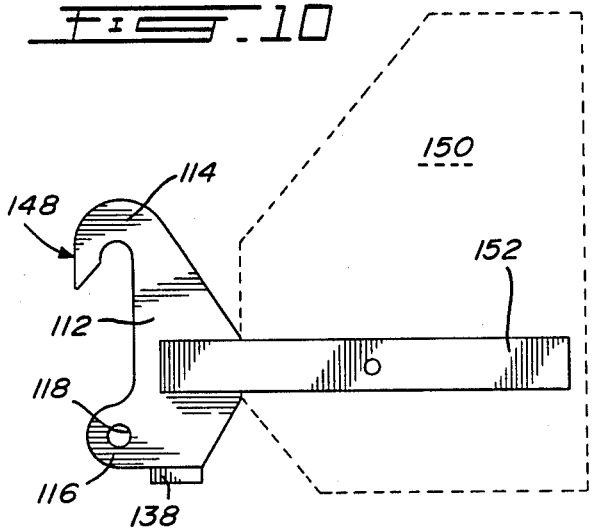
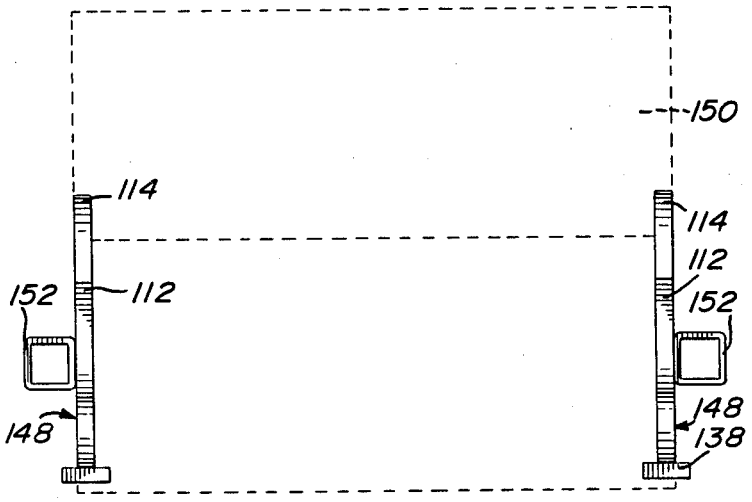
FIG. 11

HOOK TYPE QUICK COUPLING FOR TRACTOR IMPLEMENT

FIELD OF THE INVENTION

The present invention relates to a quick coupling system for coupling a working implement to the front of a vehicle, such as a tractor.

BACKGROUND OF THE INVENTION

Known systems for attaching a working implement, such as a snow-blade, a lawnmower, a snow remover, to the front of a vehicle, such as a tractor, are time-consuming to attach and detach, since known systems are fixed directly to the underside of the tractor and normally require the use of bolts and nuts. Moreover, each particular type of working implement requires its own bracket assembly adapted to be connected to the underside of the tractor, or the like vehicle. Furthermore, these bracket assemblies have to be modified each time they are to be connected to a different type of tractor.

OBJECTS OF THE INVENTION

The general object of the present invention is to provide a quick coupling assembly for tractor working implements, which will obviate the above-noted disadvantages.

A more specific object of the present invention is to provide a push-frame adapted to be mounted to the front part of a vehicle chassis, and a hook frame adapted to be permanently fixed to the working implement with quick coupling means between the two frames.

Another object of the invention is to provide a push-frame which can be raised and lowered with respect to the tractor.

Another object of the present invention is to provide a system in which the vertical inclination of the working implement can be adjusted.

SUMMARY OF THE INVENTION

There is provided, in accordance with the invention, a quick coupling assembly for coupling a working implement to the front of a vehicle. This assembly comprises a front push-frame having means to attach the same to the chassis of the vehicle in a position with the front end portion of the push-frame projecting forwardly of the vehicle. Said front portion includes upright legs disposed transversely of the push-frame, each carrying a horizontal stud and a horizontal retractable locking pin located below the respective studs.

The quick coupling assembly further includes a hook frame; means to attach the hook frame to the back of a working implement, the hook frame including a pair of transversely-spaced upright hook plates, each having an upper downwardly-inturned hook member and a hole below the hook member. The hook members are capable of removable hooking engagement with the studs of the push-frame and the locking pins are capable of engaging the holes of the hook plates for locking the two frames in coupled condition. Preferably, the front portion of the push-frame is mounted for up-and-down adjustable movement under the action of hydraulic rams, so as to adjust the level of the working implement and also to facilitate coupling of the two frames without having to manipulate the working implement resting on the ground. Preferably also, there are means to adjust the vertical inclination of the legs of the push-frame, so as to adjust the vertical inclination of the working implement coupled thereto.

BRIEF DESCRIPTION OF THE DRAWINGS

In the annexed drawings:

FIG. 10, shown on the sixth sheet of drawings, shows in side elevation another embodiment of the hook frame as connected to a snowblower casing, shown in dotted line; and FIG. 11 is an elevation of the embodiment of FIG. 10 looking from the left.

DETAILED DESCRIPTION OF THE INVENTION

Figure 1:
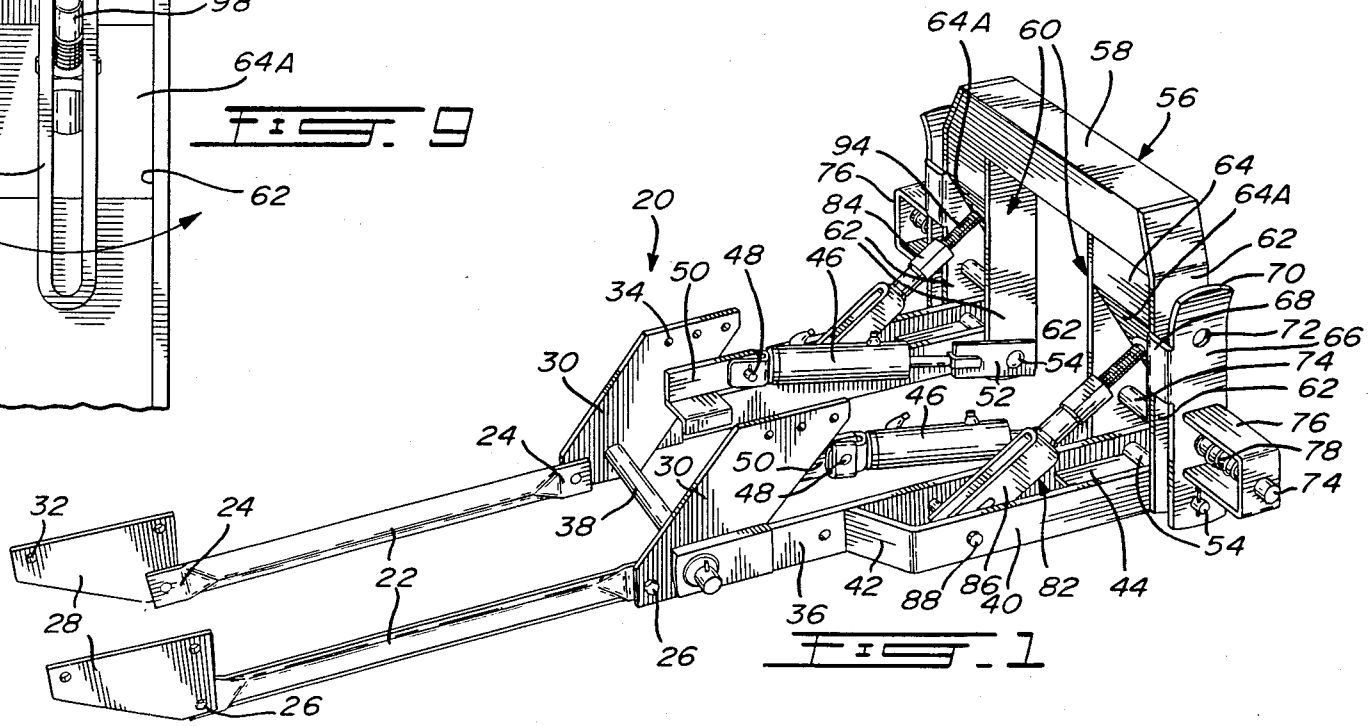
FIG. 1 is a perspective view of the push-frame, which forms part of the quick coupling assembly in accordance with the present invention.

The push-frame, generally indicated at 20 in FIG. 1, includes a pair of transversely-spaced braces 22, of triangular cross-sections, with flattened ends 24 pivotally connected at 26 to rear bracket plates 28 and to front bracket plates 30, respectively. These bracket plates 28 and 30 have fastening holes 32 and 34 for fastening the bracket plates 28 and 30 to the chassis of a vehicle, for instance a farm tractor, underneath the same, with the braces 22 extending longitudinally of the vehicle. The pivots 26 allow proper orientation of the brackets 28 and 30 to fit the tractor underside.

A pair of transversely-spaced arms 36 extend forwardly from the respective bracket plates 30 and are pivoted thereto by means of a transverse pivot axle 38. Each arm 36 is doubled on the outside by arm sections 40 secured to the respective arms 36 and extending parallel thereto, being rigidly secured thereto by inturned rear portions 42 and spacer plates 44.

The assembly of the arms 36 and arm sections 40 can be pivoted up and down with respect to the front bracket plates 30 about pivot axle 38 by means of double-acting cylinder-and-piston units 46 or hydraulic rams. The cylinders of the units 46 are pivotally attached at 48 to plates 50 secured to the bracket plates 30, while the piston rods of the units 46 are secured to plates 52, in turn pivoted to the outer ends of the arms 36 and arm sections 40 by means of transverse pivot pins 54.

An inverted yoke member 56 is pivoted to the front end of the arms 36 and arm sections 40 by means of the same pivot pins 54. Yoke frame 56 consists of an upper transverse beam 58 and of a pair of legs 60, which are transverse spaced and extend upwardly from the arms 36 and arm sections 40. The beam 58 is of tubular construction, while the legs 60 are formed of two spaced plates 62 with an intermediate web 64. ON the outside of each leg 60 thereis provided a guide plate 66 connected to each outer plate 62 by a rear web 68. Each guide plate 60 extends parallel to the leg 60 and has an outwardly-curved upper end 70.

Figures 5, 7:
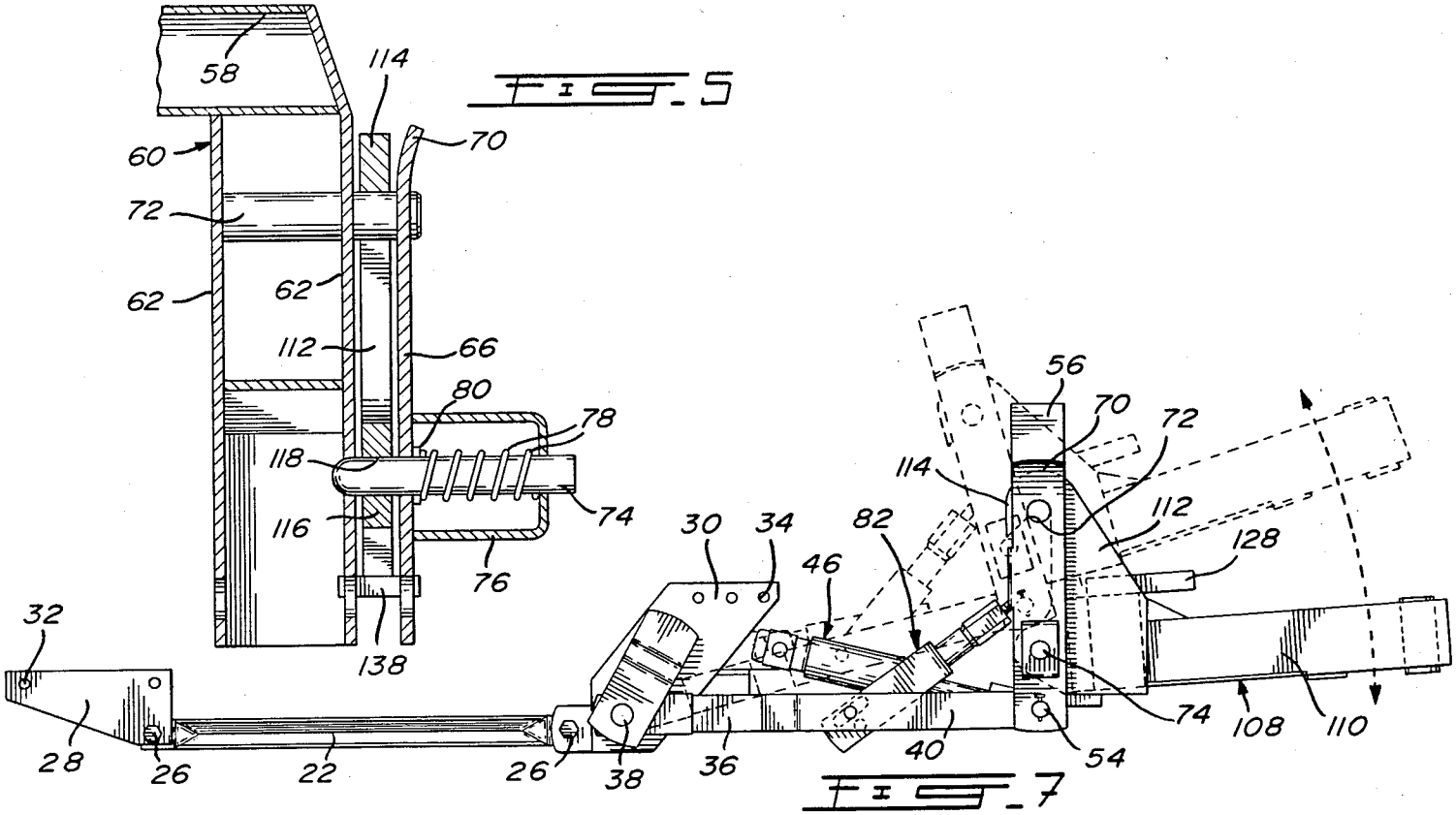
FIG. 5 is a partial vertical section taken along line 5—5 of FIG. 4.
FIG. 7, shown on the fourth sheet of drawings, is a side elevation of the coupled push-frame and hook frame.
Figure 6:
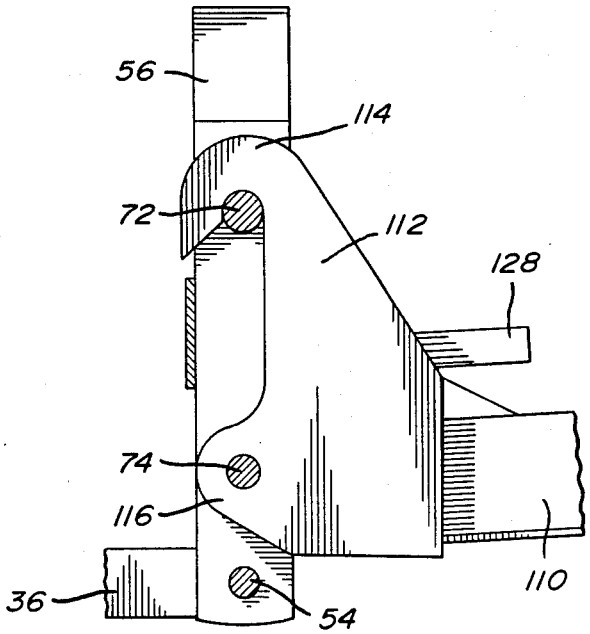
FIG. 6 is a partial vertical section, taken along line 6—6 of FIG. 4.

A stud, or pin 72 (see FIG. 5), extends through legs 60 and between the guide plate 66 and the legs 60. The two studs 72 are therefore transversely spaced in horizontal alignment. A locking pin 74 is also provided for each leg 60 and adapted to extend across the space between the guide plate 66 and the associated leg 60. Each locking pin 74 is slidably mounted within aligned holes made in the outer plate 62 of legs 60, in the guide plate 66, and also in a yoke 76 fixed to the guide plate 66 outwardly of the same. A compression coil spring surrounds the locking pin 64 between the transverse leg of the yoke 76 and the transverse retaining pin 80 fixed to the locking pin 74. Spring 78 normally maintains the locking pin 74 in a dvanced locking position, extending across the spaced between guide plate 66 and leg 60. Locking pin 74 can be pulled to retract the same from within said space.

Figure 9:
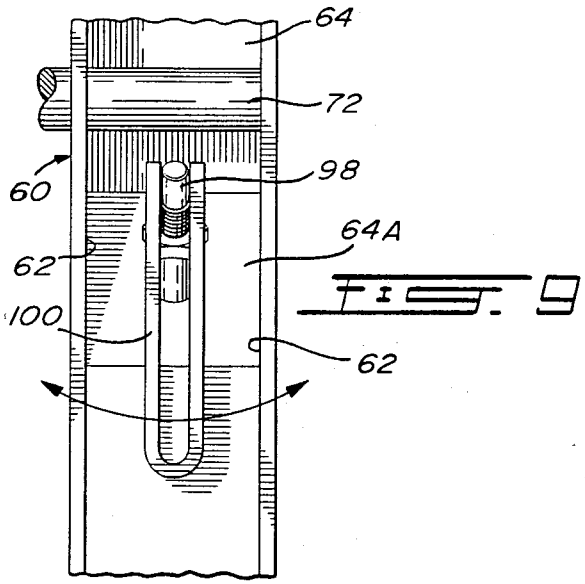
FIG. 9, shown on the first shet of drawings, is a partial elevation looking towards the left in FIG. 8.
Figure 8:
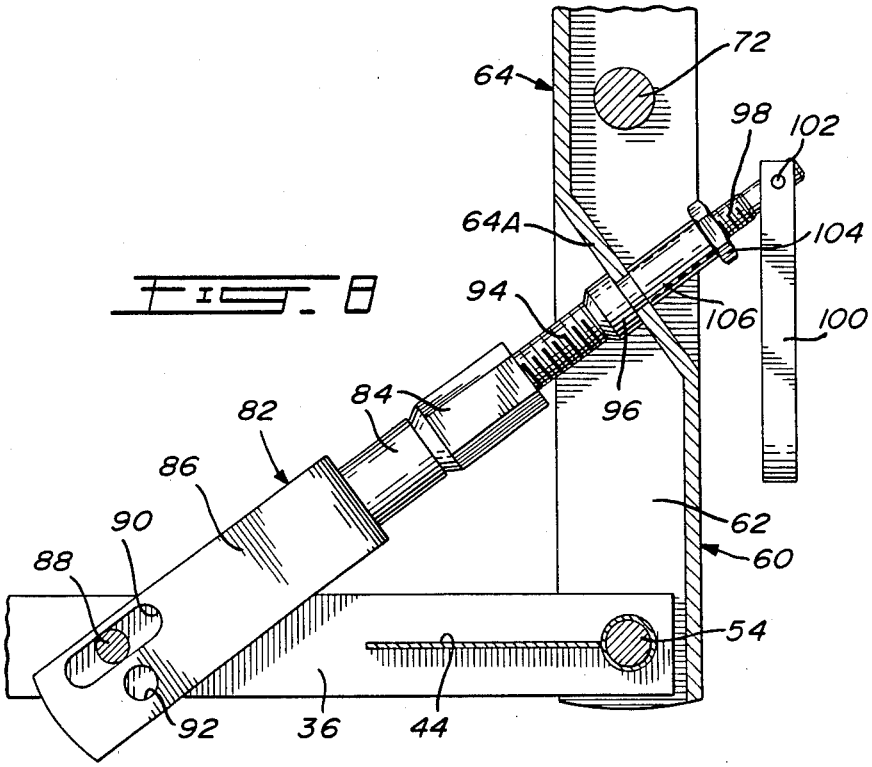
FIG. 8, shown on the fifth sheet of drawings, is a partial vertical section, taken along line 8—8 of FIG. 4.

Means are provided to retain the yoke frame 56 in upright position with respect to the arms 36 and, at the same time, to adjust the vertical angle between the yoke frame and the arms. These means (see more particularly FIGS. 1, 9, and 8) consist of a length-adjustable stay 82 on each side of the pusher frame. Each stay 82 comprises an inwardly-threaded tube 84 fixed to a yoke 86, the legs of which are pivotally connected to the arm 36 and corresponding arm section 40 by means of a transverse pivot pin 88. The pivot pin 88 may be selectively inserted through the slot 90, or through the hole 92 of the legs of the yoke 86, said legs freely extending between the arm 36 and associated arm section 40. A bolt 94 is threaded within the tube 84. This bolt 94 has collar 96 abutting against an inclined part 64A of the web 64. The bolt 94 has a portion of reduced diameter and externally threaded, which extends through a hole of inclined web parts 64A, as indicated at 98, and the outer end of the bolt 94 is provided with operating U-shaped handle 100 pioted thereto by a transverse pin 102. Therefore, it will be understood that by manipulating handle 100, bolt 94 can be rotated within or out of tube 84, so as to adjust the effective length of the stay 82, as measured from collar 96, to pivot pin 88, supposing this pivot pin is inserted through hole 92. Once this effective length has been adjusted, the bolt 94 is retained against rotation by means of a lock nut 104 screwed tight against a sleeve 106, which surrounds the reduced part 98 of bolt 94 and abuts against the inclined web portion 64A. If the pivot pin 88 is inserted in hole 92, the yoke frame 56 will be maintained at the precise adjusted angle, which it is desired, with respect to arms 36. However, if the pivot pin 88 is inserted into slot 90, the yoke will be free to pivot within a certain limit with respect to the arms 36; but the range of pivotal movement is again adjusted through means of the stays 82.

Figure 2:
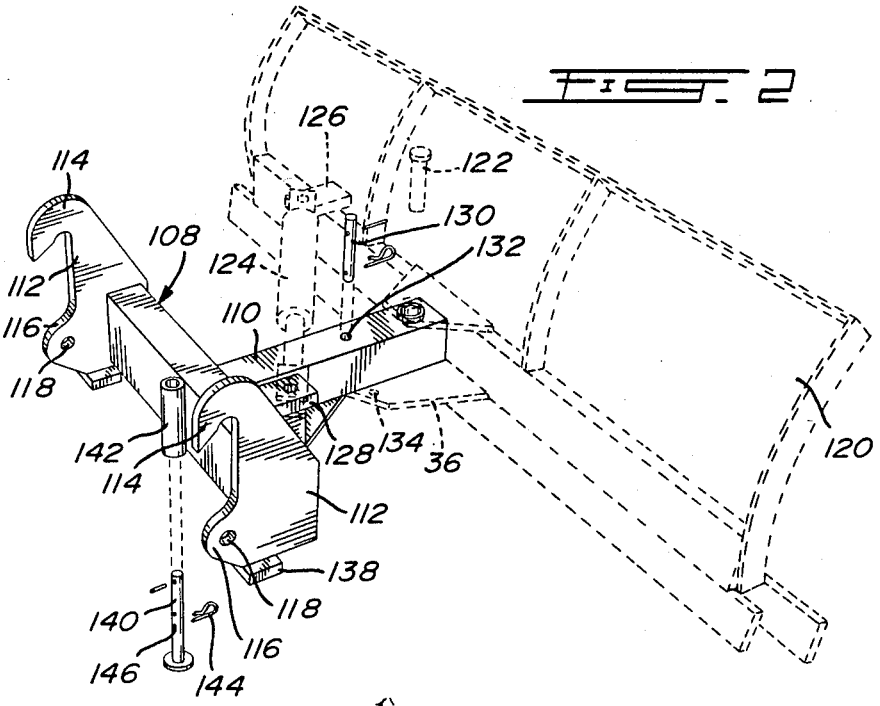
FIG. 2 is a persepective view of the hook frame, which forms the other part of the quick coupling assembly in accordance with the invention; in this figure, a snow plow, shown in dotted line, is attached to the hook frame.
Figure 3:
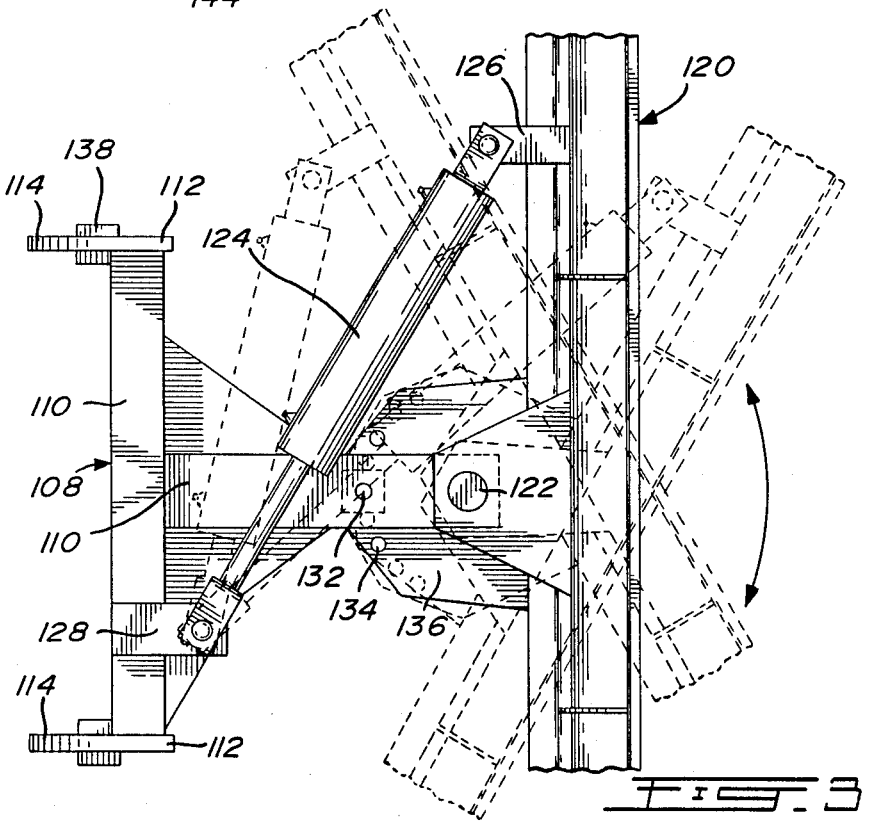
FIG. 3 is a top plan view of FIG. 2, with the snow plow shown in full line.
Figure 4:
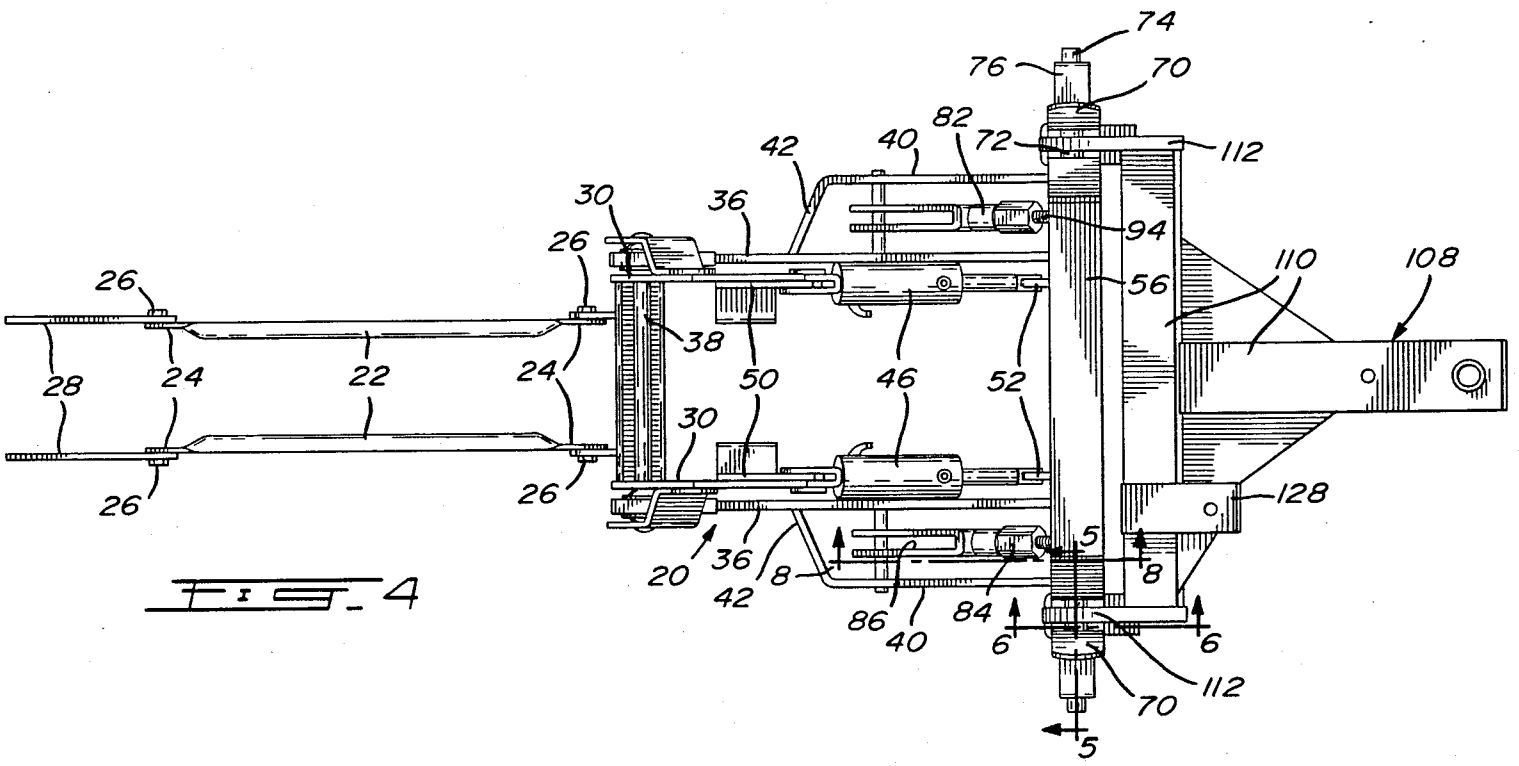
FIG. 4 is a top plan view of the assembled push-frame and hook frame, the snow plow not being shown.

The hook frame in accordance with a first embodiment of the invention is shown in FIGS. 2 and 3, generally at 108. It comprises a T-shaped beam 110. To the ends of the transverse leg thereof, are secured a pair of transversely-spaced upright hook plates 112, each provided with a downwardly-turned hook member 114 at its upper end and with a boss 116 at its lower end, in which a hole 118 is made.

In the example shown, a snow plow 120 is pivotally mounted to the front end of the main leg of the T-shaped beam 110 by means of a vertical king-pin 122. As shown in FIG. 3, the orientation or the horizontal inclination of the snow plow 120 with respect to the direction of travel of the vehicle can be adjustably varied by means of a double-acting cylinder-and-piston unit 124 pivotally attached at its ends to brackets 126, 128 secured to the snow plow 120 and to the transverse leg of the T-beam 110, respectively.

If it is not desired to constantly change the horizontal inclination of the snow plow 110, this inclination can be adjustably fixed by inserting a lock pin 130 through a hole 132, made in T-shaped beam 110, and selectively engageable with anyone of a plurality of circularly-disposed holes 134 made in a plate 136 fixed to the back of the plow 120.

Each hook plate 112 is provided it its lower end with a foot pad 138; if desired and as shown in FIG. 2, the two hook plates 112 may be temporarily maintained in raised position above ground when the working implement is not in use by a leg 140 engaging a sleeve 142 secured to the transverse leg of the T-shaped beam 110. Means, such as a cotter pin 144 insertable through a selected hole 146 of the leg 140, engages the lower end of sleeve 142 to maintain the leg 140 in inserted position within the sleeve 142.

Leg 140 will maintain the hook members 140 at the desired height, to facilitate coupling of the hook frame to the push-frame without in any way having to manually handle the assembly of the hook frame and of the snow plow.

From the foregoing, it is apparent that the push-frame 20 is adapted to be permanently mounted to the underside of the front part of the chassis of a tractor or other vehicle, with the arms 36 and the yoke-shape frame 56 protruding forwardly of the vehicle. Similarly, the hook frame 108 is adapted to be permanently secured to the back of a specific type of working implement, such as the snow plow 120, each specific type of working implement being provided with its standardized hook frame 108.

Supposing the working implement 120 of FIG. 2 rests on the ground, with the hook members 114 kept in suitably elevated position by means of leg 146, the driver of the tractor simply has to lower the yoke frame 156 by means of hydraulic rams 146 sufficiently, so that the studs 72 will be at a lower level than the hook members 114. Then he drives the vehicle so as to align the guide plates 66 on the outside of the respective hook members 114 until the studs 72 hit against the rear edge of the hook plates 112. Then he controls the rams 46 to raise the yoke frame 56 until the stud 72 engages the hook members 114. Then he disembarks from the tractor and retracts the pin 174, whereby the hook plate 112 rotates around the stud 72 until alignment of the hole 118 with the locking pin 74; the latter springs back into locking position, as shown in the final coupled position, shown in FIG. 5.

Hydraulic rams 46 are controlled during work with the implement, such as a snow plow, so as to raise or lower the same. The vertical inclination of the snow plow can be manually adjusted for a certain level of the same by manually adjusting the stays 82, as previously described.

FIGS. 10 and 11 show fundamentally the same hook frame, indicated at 148 as attached to the sides of the casing 150 of a snowblower. The two hook plates 112 are each provided with a beam 152 permanently secured to the side of the snowblower casing 150. The hook plates 112 can be easily coupled and uncoupled from the same push-frame, as above described.

In the same manner, the hook frame, which essentially consists of the two transversely-spaced hook plates 112, can be adapted to be permanently secured to any type of working implement. Therefore, the same tractor can be used in association with a great number of varieties of farm-type working implements, and the system of the invention enables a quick change of the working implement.

What I claim is:

1. A quick coupling assembly for coupling a working implement to the front of a vehicle, comprising: a front push-frame having means to attach the same to the chassis of said vehicle in a position with the front end portion of said push-frame projecting forwardly of said vehicle, said front end portion including two upright legs disposed transversely of said push-frame, a transverse stud carried by each leg, a transverse retractable locking pin carried by each leg below said stud, a hook frame, means to attach said hook frame to the back of a working implement, said hook frame including a pair of transversely-spaced upright hook plates, each having an upper downwardly-turned hook member and a hole below said hook member, said hook members capable of hooking engagement with said studs and said locking pins capable of engaging said holes for coupling said working implement to said vehicle.

2. A quick coupling assembly as defined in claim 1, further including a guide plate carried by each of said legs on the outside thereof and spaced therefrom, said stud extending transversely of the space between said guide plate and said leg, and similarly said locking pin extending across said space when engaging said hole of said hook plate.

3. A quick coupling assembly as defined in claim 2, further including spring means biasing said locking pin into locking position in engagement with said hole of said hook plate.

4. A quick coupling assembly as defined in claim 2, wherein said guide plates extend upwardly from said respective studs and are outwardly curved with respect to said legs.

5. A quick coupling assembly as defined in claim 1, wherein said push-frame includes a rear end portion provided with said attachment means, said front end portion pivotally connected to said rear end portion for up-and-down movement, and further including hydraulic rams connecting said attaching means to the front end of said front end portion for pivotally raising and lowering said front end portion with respect to said rear end portion.

6. A quick coupling assembly as defined in claim 4, wherein said push-frame includes a rear end portion provided with said attachment means, said front end portion pivotally connected to said rear end portion for up-and-down movement, and further including hydraulic rams connecting said attaching means to the front end of said front end portion for pivotally raising and lowering said front end portion with respect to said rear end portion.

7. A quick coupling assembly as defined in claim 1, wherein said push-frame includes a rear portion including a front pair and a rear-pair of upright bracket plates constituting said means to attach the push-frame to the chassis of said vehicle, the bracket plates of said front and rear pairs being transversely spaced and pivotally interconnected to common braces which extend between the bracket plates of the front and rear pairs, said front end portion of said push-frame comprising a pair of forwardly-extending arms respectively pivotally connected to the bracket plates of said front pair at the rear end thereof for up-and-down movement; and further including hydraulic rams pivotally interconnecting the bracket plates of said front pair to the forward end of said arms, respectively, said upright legs forming the side legs of an inverted U-shaped yoke frame which is pivotally connected at the lower end of said legs to the front ends of said arms; and further including length-adjustable braces extending between and connected to said arms and to said legs to maintain said legs at an adjusted vertical angle with respect to said arms.

8. A quick coupling assembly as defined in claim 7, further including a guide plate carried by each leg on the outside thereof and substantially parallel thereto, each guide plate having an outwardly-curved upper end, said guide plate being maintained spaced from the associated leg to define a guide space therebetween, said stud extending across said space, said locking pin extending across this space in locking position and clearing said space in retracted position.

9. A quick coupling assembly as defined in claim 8, further including spring means to bias said locking pin into locking position.

* * * * *